US009623944B2

(12) United States Patent
Kuehmichel et al.

(10) Patent No.: US 9,623,944 B2
(45) Date of Patent: Apr. 18, 2017

(54) RETRACTABLE DRIVE SYSTEM FOR WATERCRAFT

(71) Applicants: Blaine G. Kuehmichel, Wausau, WI (US); Robert J. McDonough, Bangor, ME (US); Geoffrey Michael Bergmark, Bangor, ME (US)

(72) Inventors: Blaine G. Kuehmichel, Wausau, WI (US); Robert J. McDonough, Bangor, ME (US); Geoffrey Michael Bergmark, Bangor, ME (US)

(73) Assignee: Johnson Outdoors Inc., Racine, WI (US)

( * ) Notice: Subject to any disclaimer, the term of this patent is extended or adjusted under 35 U.S.C. 154(b) by 0 days.

(21) Appl. No.: 14/727,501

(22) Filed: Jun. 1, 2015

(65) Prior Publication Data

US 2016/0347435 A1 Dec. 1, 2016

(51) Int. Cl.

| | |
|---|---|
| ***B63H 5/20*** | (2006.01) |
| ***B63H 16/20*** | (2006.01) |
| ***B63B 35/71*** | (2006.01) |

(52) U.S. Cl.

CPC ..... *B63H 16/20* (2013.01); *B63B 35/71* (2013.01); *B63H 2016/202* (2013.01)

(58) Field of Classification Search

CPC ..... B63H 20/08

See application file for complete search history.

(56) References Cited

U.S. PATENT DOCUMENTS

| | | | | |
|---|---|---|---|---|
| 4,676,755 | A | 6/1987 | Yagan | |
| 4,872,859 | A * | 10/1989 | Griffiths | B63H 20/08 248/640 |
| 5,129,845 | A | 7/1992 | Henderson | |
| 6,022,249 | A | 2/2000 | Ketterman | |
| 6,458,004 | B2 | 10/2002 | Van Breems | |
| 7,637,791 | B2 | 12/2009 | Ketterman et al. | |
| 7,887,381 | B2 | 2/2011 | Brass et al. | |
| 8,337,266 | B2 | 12/2012 | Ellis et al. | |
| 8,398,446 | B2 | 3/2013 | Railey et al. | |
| 9,150,295 | B2 | 10/2015 | West et al. | |
| 2005/0255761 | A1 | 11/2005 | Bernloehr et al. | |
| 2005/0268833 | A1 | 12/2005 | Conrad | |
| 2007/0012236 | A1 | 1/2007 | Caples | |
| 2008/0299842 | A1 | 12/2008 | Ellis et al. | |

(Continued)

FOREIGN PATENT DOCUMENTS

| | | | |
|---|---|---|---|
| GB | 2403461 | A | 1/2005 |

OTHER PUBLICATIONS

Propel Drive, Native Watercraft; "Forward+ Reverse= Fishing Success"; pages printed from the in internet; date last visited Oct. 2, 2015; 5 pages; http://www.firstwithreverse.com/propel-drive/.

(Continued)

*Primary Examiner* — Stephan Avila

(74) *Attorney, Agent, or Firm* — Reinhart Boerner Van Deuren P.C.

(57) ABSTRACT

A drive system pivot assembly for a personal user powered watercraft is provided. The drive system pivot assembly pivots a drive system between a deployed position and a parked position. The drive system pivot assembly includes a catch arrangement for securing the drive system pivot assembly in the parked position.

22 Claims, 12 Drawing Sheets

(56) References Cited

U.S. PATENT DOCUMENTS

| | | | | |
|---|---|---|---|---|
| 2009/0031941 | A1 | 2/2009 | Czarnowski et al. | |
| 2009/0042461 | A1 * | 2/2009 | Walton | B63B 35/71 440/6 |
| 2009/0311926 | A1 | 12/2009 | Ketterman et al. | |
| 2010/0075550 | A1 | 3/2010 | Bortsov et al. | |
| 2010/0162938 | A1 | 7/2010 | Halfon | |
| 2013/0059489 | A1 | 3/2013 | Vlock et al. | |
| 2014/0134901 | A1 | 5/2014 | Ketterman et al. | |

OTHER PUBLICATIONS

Miragedrive: Hobie Cat; Mirage Drive with Glide Technology; pages printed from the internet; date last visited Oct. 2, 2015; 2 pages; http://www.hobiecat.com/mirage/miragedrive.

Lake George Kayak Co; Ultimate 14.5 Volt; Internet printout accessed on Oct. 2, 2015; 2 pages; http://www.lakegeorgekayak.com/Native_kayaks_Ultimate_14.5_Volt_specs.htm.

ack.com; Ocean Kayak Torque Motorized Fishing Kayak; internet printout accessed on Oct. 2, 2015; 2 pages; http.//www.austinkayak.com/products/14575/Ocean-Kayak-Torque-Motorized-Fishing-Kayak.html.

Hobie Evolve; Hobie evolve Control Unit; internet printout accessed on Oct. 2, 2015; 2 pages; http://www.hobiecat.com/accessories/evolve.

kayakfishingstuff.com; Ocean Kayak Torque; internet printout accessed on Oct. 2, 2015; 3 pages; http://www.kayakfishingstuff.com/drupal/content/ocean-kayak-torque.

* cited by examiner

RETRACTABLE DRIVE SYSTEM FOR WATERCRAFT

FIELD OF THE INVENTION

This invention generally relates to drive systems for watercraft.

BACKGROUND OF THE INVENTION

It is desirable to have propulsion devices for self-propelling personal watercraft such as kayaks other than use of the typical paddle. One particular method of propelling personal watercraft is to use pedal systems that convert force produced by a user's legs into a propulsion force to propel the watercraft.

For these propulsion devices to work efficiently, they must extend below the bottom of the personal watercraft such that an output of the propulsion device extends into the water.

Unfortunately, if the propulsion device contacts with the bottom of the body of water when approaching shore or when operating in shallow water, the propulsion device may become damaged or hung up on the bottom of the body of water inhibiting motion of the watercraft.

BRIEF SUMMARY OF THE INVENTION

Embodiments of the invention relate to improvements in personal watercraft. In one embodiment, a watercraft including a hull, a drive system and a drive system pivot assembly is provided. The hull defines an opening therethrough from a top side to a bottom side. The drive system has an input for receiving input force from a user and an output operably coupled to the input for providing motive force to the hull. The drive system pivot assembly transitions the drive system between a deployed position and a parked position. The drive system pivot assembly includes first and second linkage members and a catch arrangement. The first linkage member carries the output of the drive system. The second linkage member is pivotably coupled to the first linkage member at a first pivot and pivotably coupled to the hull at a second pivot spaced from the first pivot. The catch arrangement is interposed between the first linkage member and the hull for securing the drive system pivot assembly in the parked position. The catch arrangement includes a first linkage catch member provided by the first linkage member and a first hull catch member provided by the hull. The first linkage catch member and first hull catch member engage to prevent the drive system pivot assembly from transitioning from the parked position to the deployed position. The engagement prevents motion by operably using the hull to prevent motion.

In one embodiment, the first linkage member pivots about the first and second pivots when transitioning between the deployed and parked positions.

In one embodiment, one of the first linkage catch member and first hull catch member is a projection and the other one of the first linkage catch member and first hull catch member is a groove configured to receive the projection when engaged.

In one embodiment, the groove and projection are configured such that the first linkage member must transition vertically against the force of gravity to disengage the projection from the groove. In one embodiment, a biasing member inhibits this motion.

In one embodiment, the pivot assembly includes a cam surface adjacent the catch member in the form of a groove.

The projection slides on the cam surface during at least part of the transition from the deployed position to the parked position.

In one embodiment, the second linkage member pivots about the second pivot in a direction away from a user operating location when transitioning from the deployed position to the parked position.

In one embodiment, the input is a pedal system and the output is a rotating propeller operably coupled to the pedal system such that actuation of the pedal system drives the propeller.

In one embodiment, in the deployed position, the output extends a first distance below a bottom of the hull. In the parked position, the output extends a second distance below the bottom of the hull being less than the first distance or is positioned above the bottom of the hull.

In one embodiment, a docking feature is interposed between the first and second linkage members limiting the pivoting motion of the first and second linkage members when in the parked position.

In one embodiment, the hull provides a pivot groove pivotably receiving a pivot member of the second linkage member to provide the pivotable coupling between the hull and the second linkage member.

In one embodiment, the pivot groove extends longitudinally in a direction generally perpendicular to a centerline of the hull extending between a bow and a stern of the hull.

In one embodiment, one of the pivot groove and the pivot member has a curved surface portion providing a sliding interface between a surface defining the pivot groove and the pivot member when the pivot member is rotated about a longitudinal axis thereof as the drive system pivot assembly is transitioned between the deployed and park positions.

In one embodiment, the hull is the hull of a kayak.

In one embodiment, the docking feature is a U-shaped clip that engages the first linkage member in the parked position.

In one embodiment, the hull includes a hull body and an attachment plate attached to the hull body, the attachment plate providing the first hull catch member.

In one embodiment, the attachment plate further includes a second hull catch member in which the first linkage catch member resides in the parked position.

In one embodiment, a biasing mechanism provides a biasing force that biases the drive system pivot assembly from the deployed position toward the parked position.

In one embodiment, the biasing mechanism is connected between the first and second linkage members.

In one embodiment, a pivoting drive system for a watercraft is provided. The pivoting drive system is for a watercraft having a first mounting component and a first hull catch member. The pivoting drive system includes an output for providing motive force when operated within water and drive system pivot assembly for transitioning the output between a deployed position and a parked position. The drive system pivot assembly includes a first linkage member carrying the output; a second linkage member pivotably coupled to the first linkage member at a first pivot and having a pivotable coupling configured to pivotably attach the second linkage member to the first mounting component; and a linkage catch member provided by the first linkage member configured to engage the first catch component for securing the drive system pivot assembly in the parked position, the linkage catch member and first hull catch member engaging in the parked position to prevent the drive system pivot assembly from transitioning from the parked position to the deployed position.

In one embodiment, the first catch member is a groove and the linkage catch member is a projection configured to extend into the groove in such a manner to fix the location of the first linkage member to the second linkage member and maintain the drive system pivot assembly in the parked position.

In one embodiment, the projection is configured relative to the groove such that the first linkage member must transition vertically against the force of gravity to disengage the projection from the groove.

In one embodiment, the first mounting component is a groove extending perpendicular to a centerline of the watercraft extending between the stern and the bow of the watercraft. The pivotable coupling is a rod having an outer periphery including a curved pivot surface.

Other aspects, objectives and advantages of the invention will become more apparent from the following detailed description when taken in conjunction with the accompanying drawings.

BRIEF DESCRIPTION OF THE DRAWINGS

The accompanying drawings incorporated in and forming a part of the specification illustrate several aspects of the present invention and, together with the description, serve to explain the principles of the invention. In the drawings.

While the invention will be described in connection with certain preferred embodiments, there is no intent to limit it to those embodiments. On the contrary, the intent is to cover all alternatives, modifications and equivalents as included within the spirit and scope of the invention as defined by the appended claims.

DETAILED DESCRIPTION OF THE INVENTION

Figure 1:
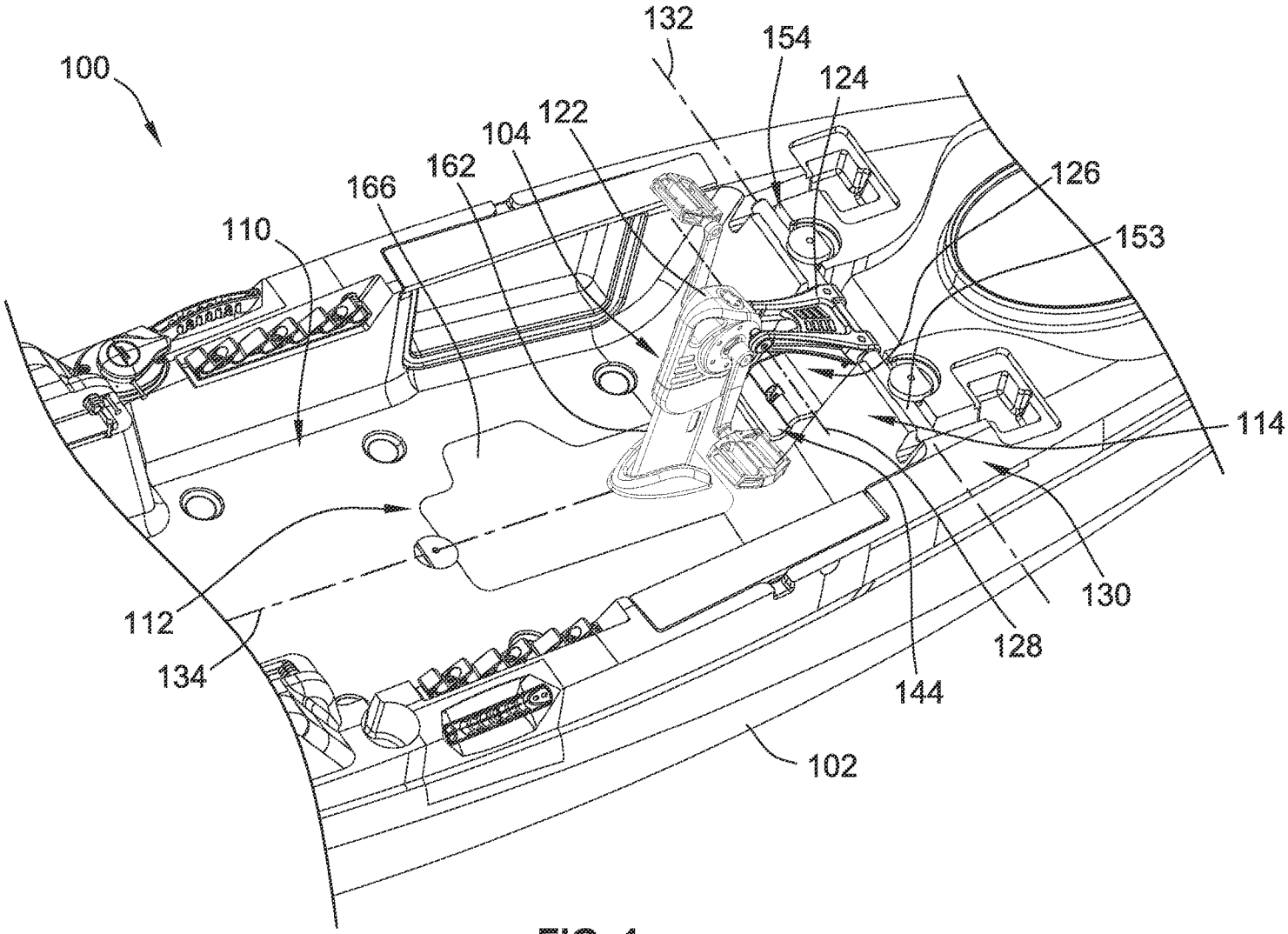
FIG. 1 is a top perspective view of a watercraft according to an embodiment of the invention with the drive system pivot assembly in a deployed position.

FIG. 1 illustrates an embodiment of a watercraft 100 according to the invention. The watercraft 100 is illustrated in the form of a kayak but could take other forms of watercraft such as canoes.

The watercraft 100 includes a hull 102 and a drive system 104 for converting an input from a user into a motive force for propelling the watercraft 100. In the illustrated embodiment, the drive system 104 is a pedal drive system that converts a pedaling motion from the user into motive force. With additional reference to FIG. 2, the drive system 104 uses the rotary motion from pedaling to rotationally drive a propeller 106. Other drive systems are contemplated. For instance, a pumping style drive system could be used where the user pushes back and forth on pedals rather than rotates pedals like in the illustrated embodiment to provide motive force. Further, rather than have a rotary driven propeller, reciprocating blades could be used to create the motive force for propelling the watercraft 100.

Drive system 104 is generally located forward of a seating area 110 where the user will generally be seated during operation of the watercraft 100. The hull 102 includes an opening 112 (see FIG. 2) extending therethrough from a top side to a bottom side forward of the seating area 110 through which the drive system 104 extends when the drive system is in a deployed position (see FIG. 1).

Figure 2:
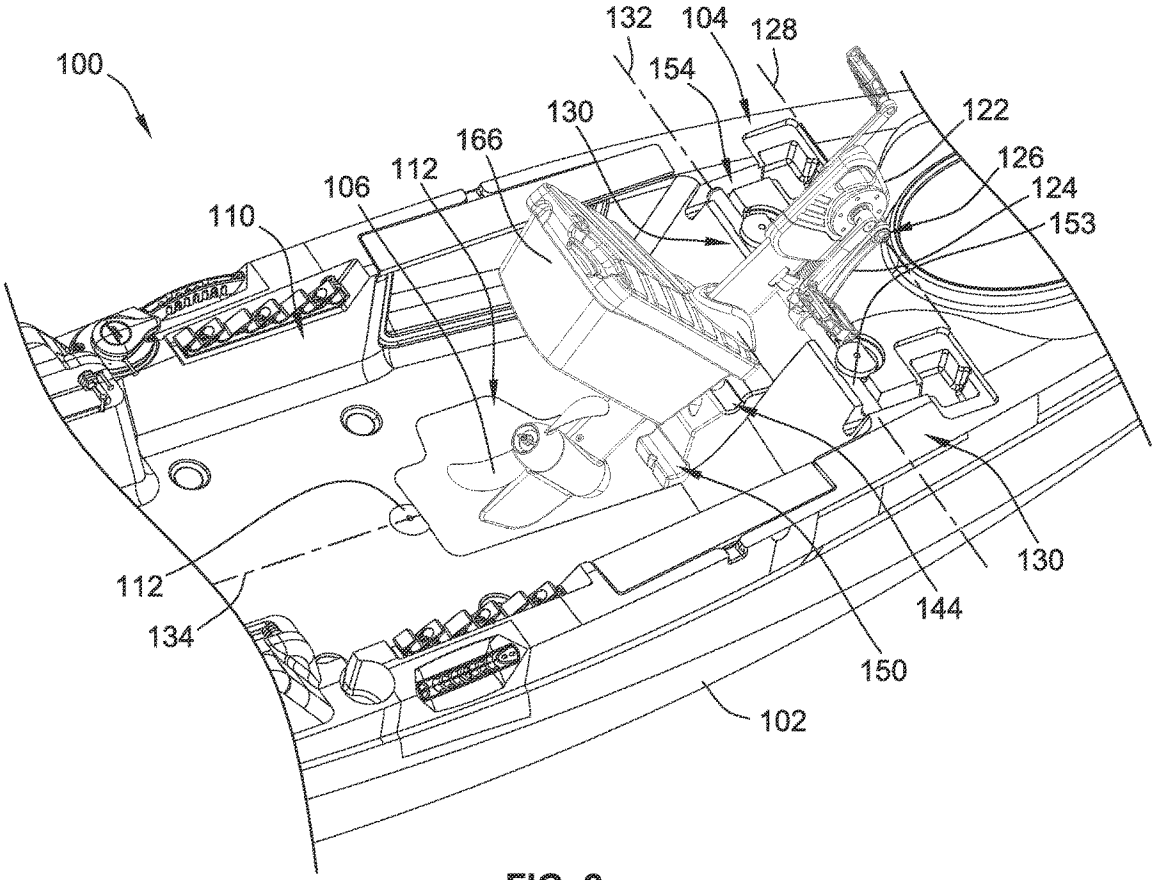
FIG. 2 is a top perspective view of the watercraft of FIG. 1 with the drive system pivot assembly in a parked position.
Figure 3:
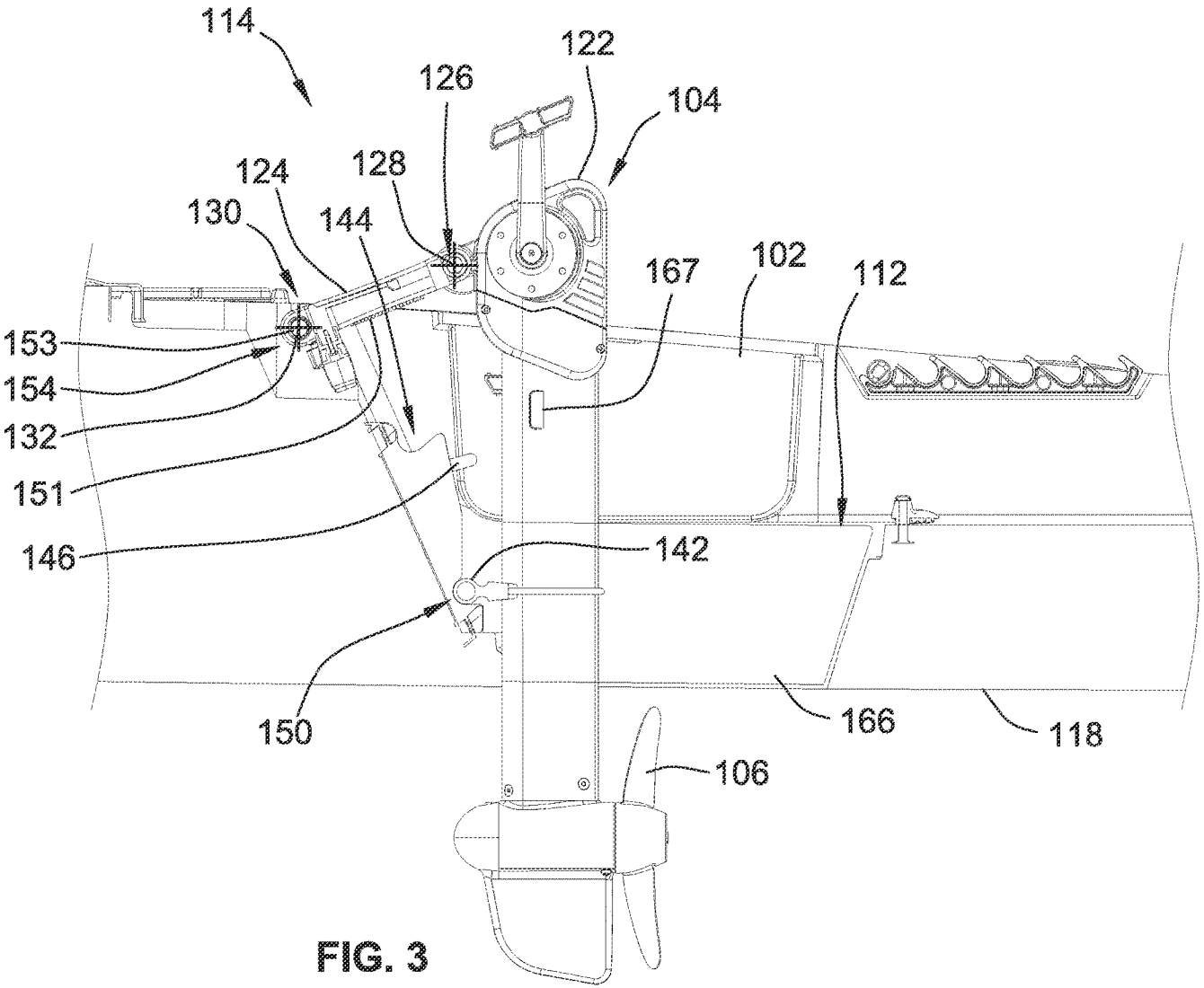
FIG. 3 is a partial side illustration of the watercraft of FIG. 1 with the drive system pivot assembly in a deployed position.
Figure 4:
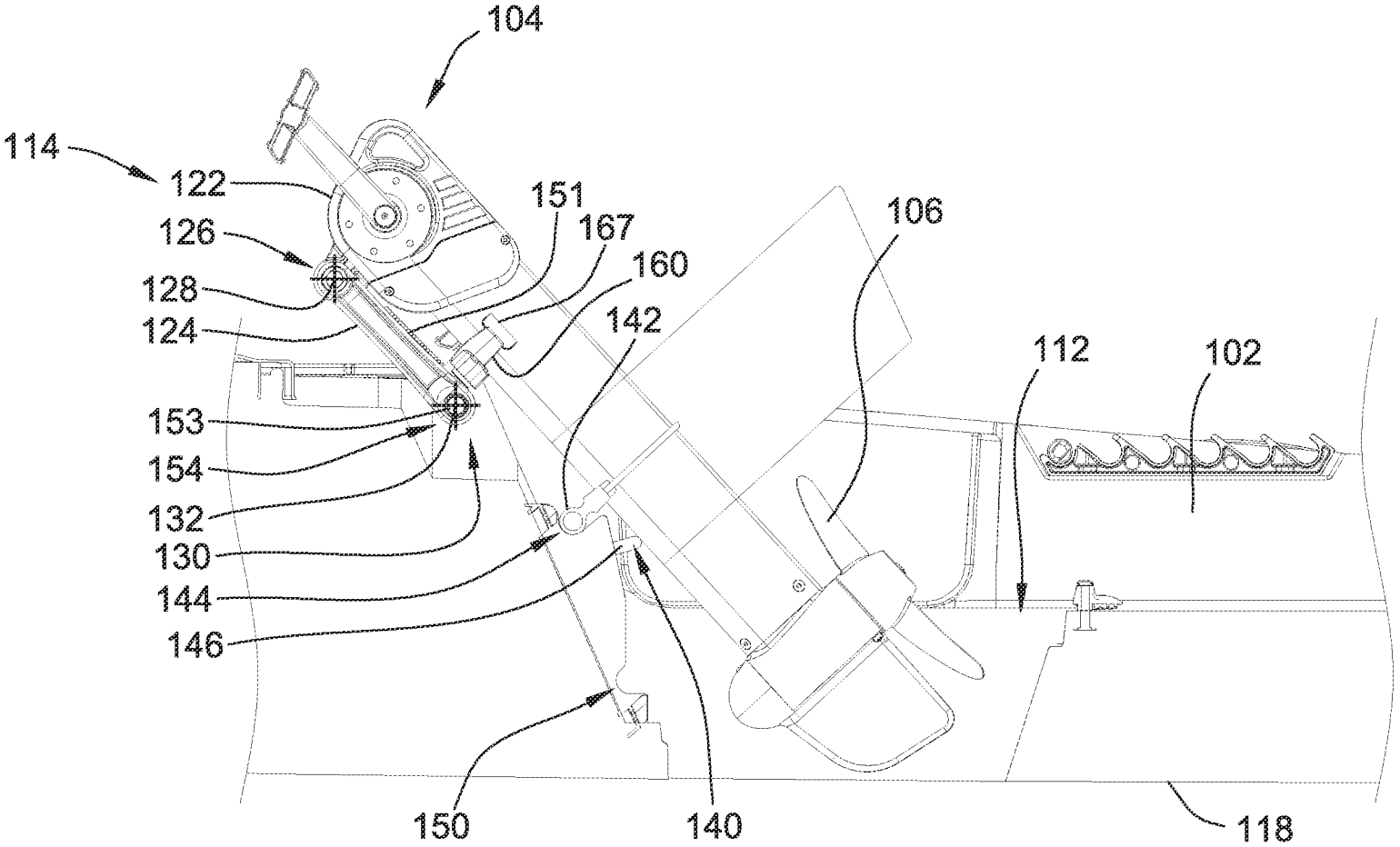
FIG. 4 is a partial side illustration of the watercraft of FIG. 1 with the drive system pivot assembly in a parked position.

The watercraft 100 includes a drive system pivot assembly 114 for transitioning the drive system 104 between the deployed position (FIGS. 1 and 3) and a parked position (FIGS. 2 and 4). In the deployed position, the propeller 106 (i.e. output of the drive system 104) will be vertically lower than in the parked position. Preferably, the output, e.g. propeller 106 is positioned vertically below a bottom 118 of the hull in the deployed position so as to allow for maximum propulsion of the watercraft. At a minimum, the output will be positioned vertically lower in the deployed position than in the parked position.

Preferably, the entire drive system 104 is raised vertically above a bottom most extent of the bottom 118 in the parked position, as illustrated in FIG. 4. This configuration prevents the drive system 104 from contacting the bottom of the body of water in which the watercraft is being used. This prevents damage to the drive system 104. As illustrated in FIG. 2, in some embodiments, it is desirous for the user to have access to the output (propeller 106) in the parked position to allow for cleaning debris from the drive system 104 (e.g. weeds) as well as to allow for maintenance in the event of damage to the drive system 104, such as breakage of the propeller 106.

The drive system pivot assembly 114 includes a first linkage member 122 that operably carries the propeller 106 for rotation about an output axis of rotation. The first linkage member 122 is operably pivotably coupled to a second linkage member 124 at a first pivot 126 defining a first pivot axis 128 about which the first and second linkage members 122, 124 rotate relative to one another when transitioning between the deployed and parked positions.

The second linkage member 124 is operably pivotably coupled to hull at a second pivot 130 defining a second pivot axis 132 about which the second linkage 124 rotates relative to the hull 102. The first and second pivots 126, 130 and, consequently, the first and second pivot axes 128, 132 are spaced apart from one another. In the illustrated embodiment, the first and second pivots 126, 130 are located generally at opposed ends of the second linkage member 124. Additionally, the first and second pivot axes 128, 132 extend parallel to one another and perpendicular to a centerline 134 of the watercraft 100.

A catch arrangement 140 (see FIG. 4) between the first linkage member 122 and the hull 102 secures the drive system pivot assembly 114 in the parked position. The catch arrangement 140 includes a first linkage catch member 142 provided by the first linkage member 122 and a first hull catch member 144 provided by the hull 102. The first linkage catch member 142 engages the first hull catch member 144 to prevent the drive system pivot assembly 114 from transitioning from the parked position (FIG. 4) to the deployed position (FIG. 3).

In the illustrated embodiment, the first linkage catch member 142 is a projection and the first hull catch member 144 is a groove configured to receive the first linkage catch member 142. The groove defines a mouth for entry of and withdrawal of the first linkage catch member 142. In other embodiments, the arrangement could be reversed. The first linkage catch member 142 and first hull catch member 144 are configured such that the first linkage member 122, and particularly the first linkage catch member 142 provided thereby, must transition vertically against the force of gravity to disengage the first linkage catch member 142 from the first hull catch member 144. In some embodiments, the dimensions and shape of the mouth of the groove and projection could be configured such that the first linkage catch member 142 snap engages with the first hull catch member 144 to help secure the two components in engagement.

The drive system pivot assembly catch arrangement includes a second hull catch member 150 in the form of a shelf or groove. The second hull catch member 150 cooperates with the first linkage catch member 142 in the parked position.

Figure 5:
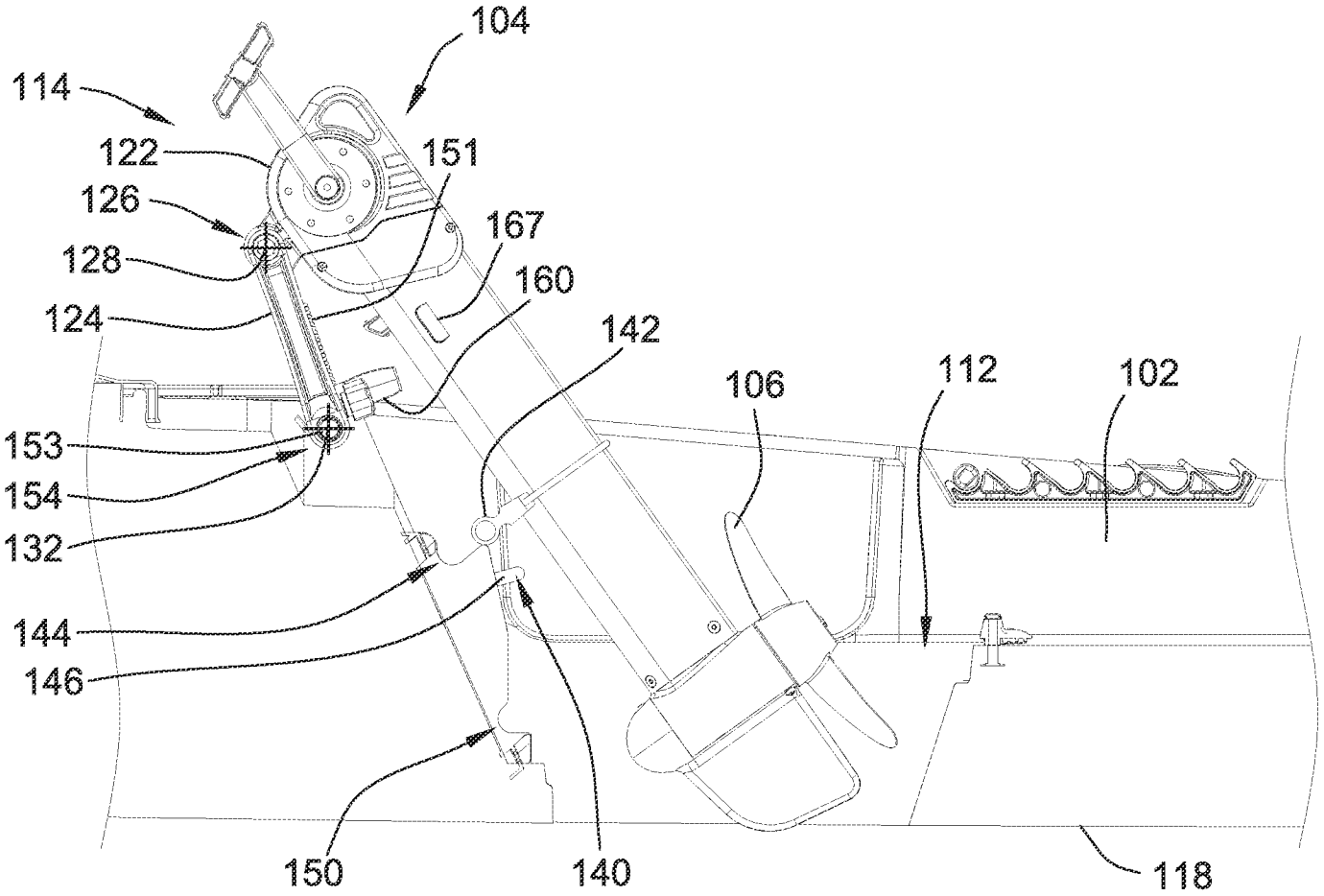
FIGS. 5 and 6 are partial side illustrations of the watercraft of FIG. 1 with the drive system pivot assembly transitioning between the parked and deployed positions.
Figure 6:
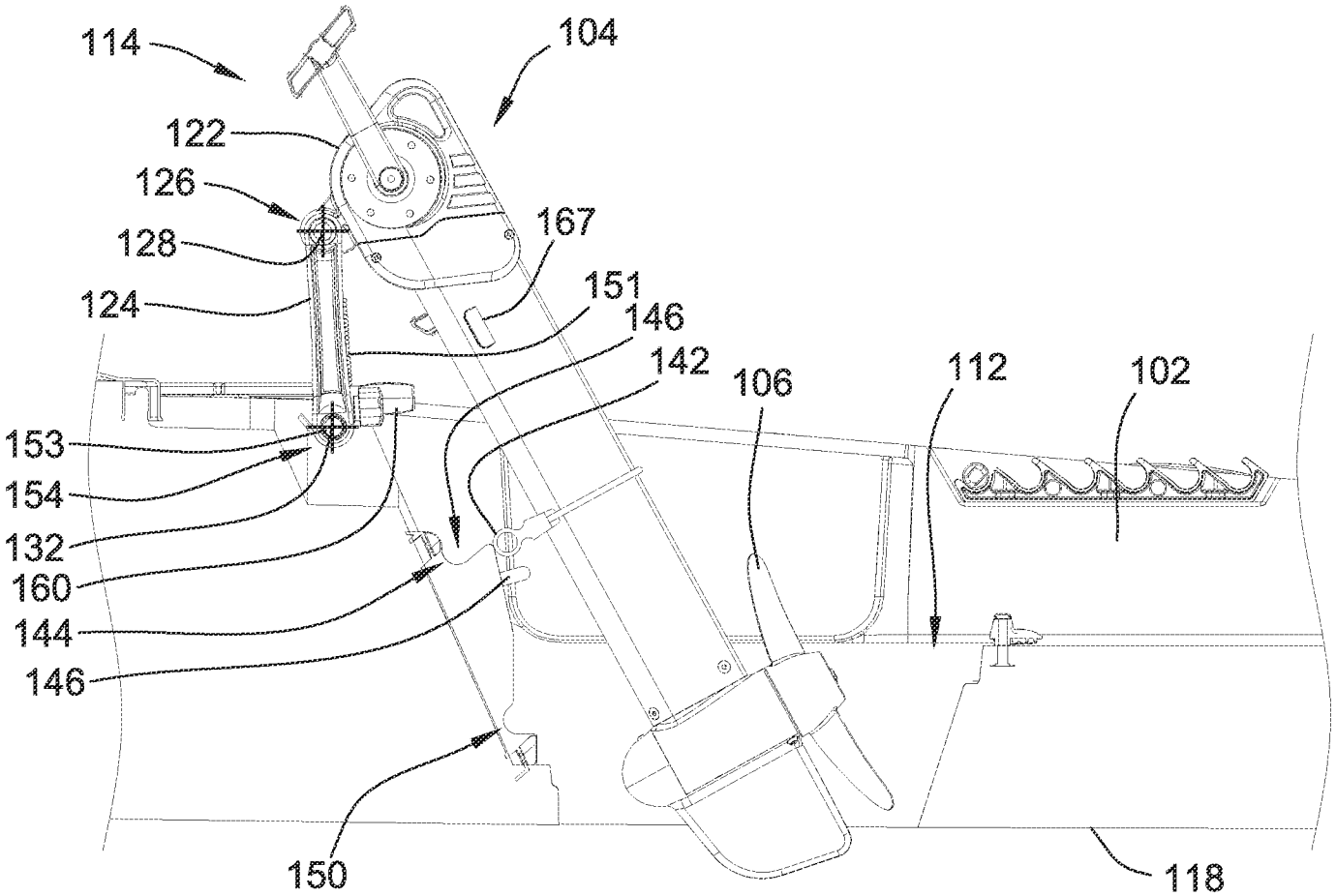

In the illustrated embodiment, the drive system pivot assembly 114 includes a guide surface 146 along which an outer surface of the first linkage catch member 142 slides as the drive system pivot assembly 114 transitions between the deployed position and the parked position. The guide surface 146 transitions between the first and second hull catch members 144, 150. The guide surface 146 helps support the weight of the drive system when transitioning between the deployed position and the parked position. This is illustrated in FIGS. 5 and 6.

The system also includes a biasing member 151 that biases the drive system pivot assembly 114 to the parked position. The biasing member 151 may be in the form of a tension spring extending between the first and second linkage members 122, 124. Alternatively, biasing member 151 could be a torsion spring acting to bias the drive system pivot assembly 114 towards the parked position.

The biasing member 151 helps reduce the amount of force required to lift the drive system 104 via the drive system pivot assembly 114 to the parked position. The biasing member 151 will also provide a force that helps maintain the first linkage catch member 142 engaged with the first hull catch member 144 upon sudden impacts on the watercraft, such as during rougher water or when dragging the watercraft onto shore.

The biasing member 151 will also provide more controlled transitions between the parked position and the deployed position by opposing motion towards the deployed position. A pivot point of biasing member 151 where it is connected to the first linkage member 122 will be offset from pivot 128 to allow for the biasing member 151 to act on the first linkage member 122.

In some embodiments, a mechanical latch may be provided to secure the drive system pivot assembly 114 in the parked position. The mechanical latch may have operation such that as the drive system pivot assembly 114 transitions to the parked position the mechanical latch automatically engages to secure the drive system pivot assembly 114 in the parked position.

In some embodiments, the drive system pivot assembly is configured such that the transition from the deployed position to the parked position can be performed using a single hand.

As illustrated in FIG. 5, the first linkage catch member 142 must raise up and over the hump that helps define the groove that receives the first linkage catch member 142.

The first linkage catch member 142 can be integrally formed with the remainder of the first linkage member 124 or, as illustrated, it could be a second component operably connected to the first linkage member 124 for movement with the first linkage member. Similarly, the first and second hull catch members 144, 150 may be integrally formed by the hull body or operably attached to the hull body. In some embodiments, the first and second hull catch members 144, 150 are formed in a secondary plate that is then attached to the hull body. The plate may be referred to as an attachment plate.

As illustrated in the transition from the deployed position to the parked position (see e.g. FIGS. 3-6), the second linkage member 124 will pivot via both the first and second pivots 126, 130 and in a direction away from the seating area 110 when transitioning from the deployed position to the parked position as well as vertically upward as discussed previously.

The second pivot 130 is provided by a pivot member in the form of a laterally extending bar 153 attached proximate an end of the second linkage member 124 and a pivot groove 154 formed in the hull 102. The pivot groove 154 pivotably receives the pivot member to provide the pivotable coupling between the hull 102 and the second linkage member 124. The pivot groove 143 and the bar 153 generally extend longitudinally in a direction that is generally perpendicular to the centerline 134 of the watercraft. Preferably, one of the surface defining the pivot groove 154 or the bar 153 received therein includes a curved profile to provide a smooth sliding interface therebetween. The smooth interface facilitates rotation about the second pivot axis when transitioning the drive system pivot assembly between the deployed and parked positions.

A locking mechanism may be provided for securing the bar 153 in the pivot groove 154. In one embodiment, one or more latches 155 releasably secure the bar 153 in pivot groove 154. Preferably, one latch is on opposite sides of the drive assembly. Further, the latches 155 preferably pivot about a rotational axis between a locked state that secures the bar 153 in pivot groove 154 and an unlocked state where the bar 153 may be removed from the pivot groove 154.

In other embodiments, the locking mechanism may be provided by a mouth of the pivot groove 154. More particularly, the mouth of the pivot groove 154 may be sized slightly smaller than the diameter of bar 153 such that the pivot groove 154 generally has a C-shaped profile and the bar 153 snaps into the pivot groove 154 to help secure the bar 153 therein.

Figure 7:
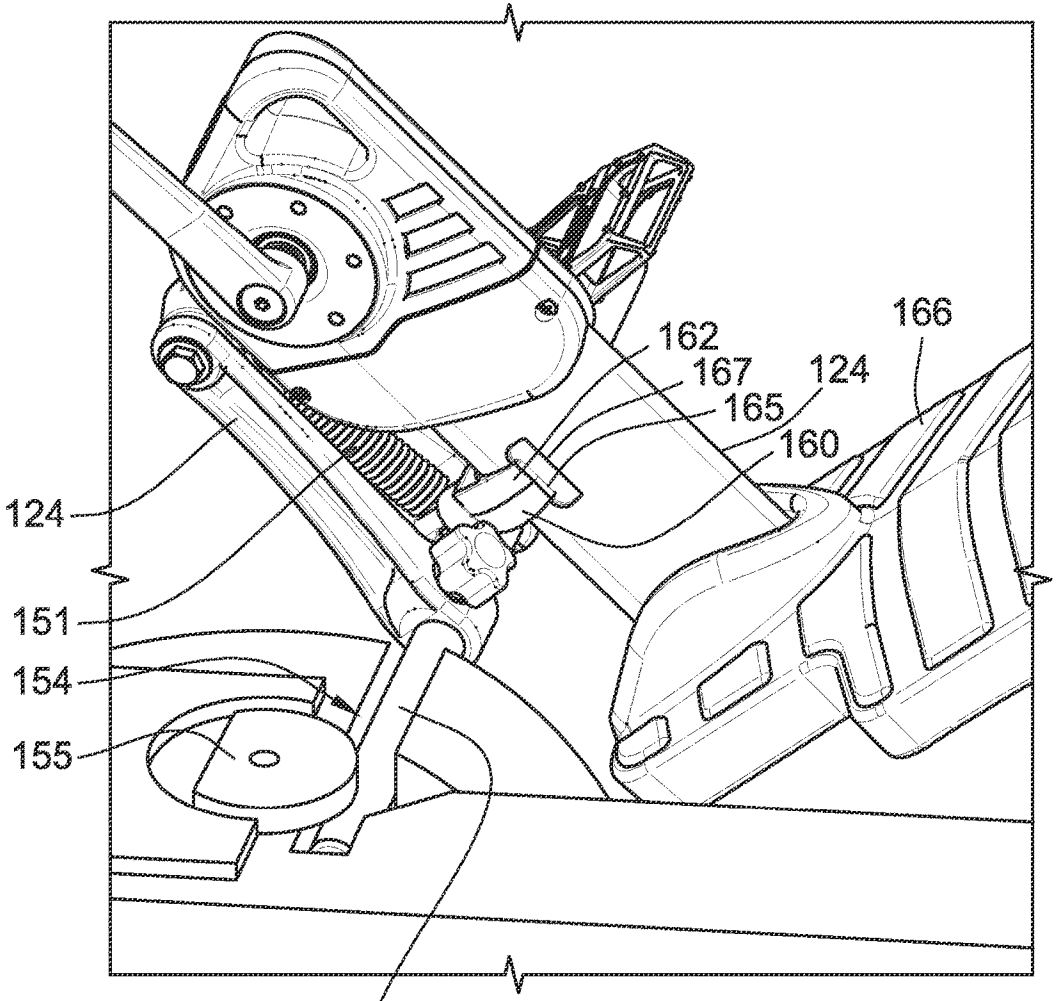
FIG. 7 is an enlarged illustration of the drive system pivot assembly.

With additional reference to FIG. 7, a docking feature 160 is interposed between the first and second linkage members 122, 124. In the illustrated embodiment, the docking feature 160 limits the relative pivoting motion of the first and second linkages when in the parked position. The illustrated docking feature 160 is a U-shaped clip portion that receives the first linkage member 122 and is carried by the second linkage member 124.

Figure 8:
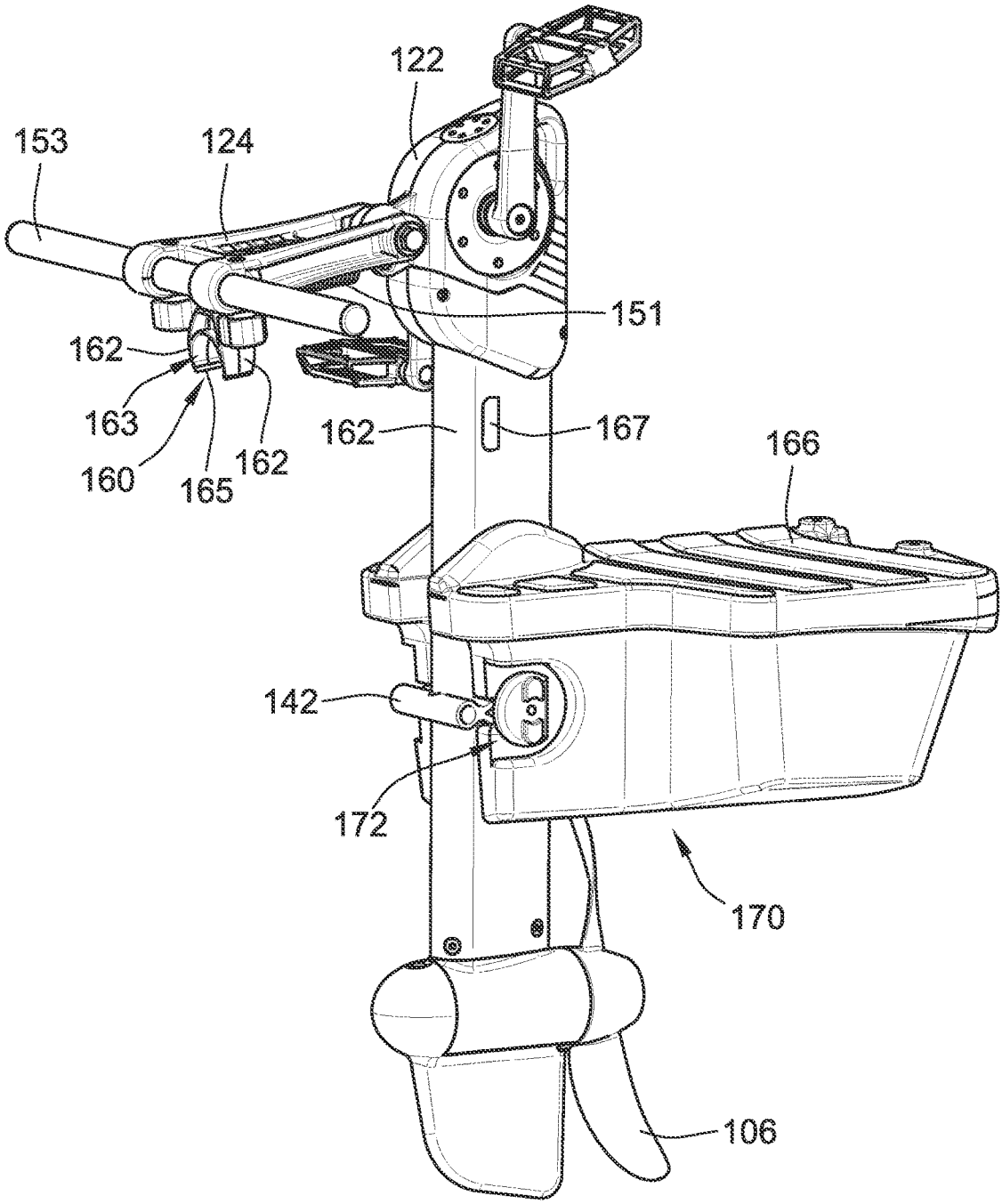
FIG. 8 illustrates the drive system pivot assembly removed from the watercraft.

The docking feature 160 includes opposed legs 161 (see also FIG. 8) that form a slot 163 therebetween that receives the first linkage member 122. The legs 161 pinch the first linkage member 122 therebetween. The docking feature 160 and first linkage member 122 have a cooperating catch arrangement that engages when in the parked position. More particularly, the ends of the legs 161 have inward extending flanges 165 that engage outward extending projections 167 of the first linkage member 122. This provides a positive engagement when in the parked position to help secure the system in the parked position.

The first linkage member 122 is, in the illustrated embodiment, generally an assembly of components that supports the input (pedals) and output (prop) of the drive system 104. The assembly of components includes a generally hollow member 162 through which connection mechanisms, e.g. chains, belts, or shafts, that operably connect the input to the output extend.

With reference to FIG. 1, a console member 166 is operably attached to the first linkage member 122 and particularly to hollow member 162. The console member 166 closes off most if not all of the opening 112 through the hull 102 when the drive system pivot assembly 114 is in the deployed position. As illustrate din FIG. 2, because the console member 166 is attached to the first linkage member 122, the console member 166 transitions with the first linkage member 122 while the drive system pivot assembly transitions between the deployed and parked positions.

The console member 166 may include a handle for the user to grasp while transitioning between the deployed and parked positions.

A latch arrangement may also be provided between the plug member 166 and the hull 102 to lock the drive system pivot assembly 114 in the deployed state. The latch arrangement can be selectively disengaged to allow form transitioning from the deployed position to the parked position.

The console member 166 may have a shelf feature 170 that cooperates with a corresponding feature of the hull 102 proximate the opening 112 to help support the drive system 104 when in the deployed position.

Figure 9:
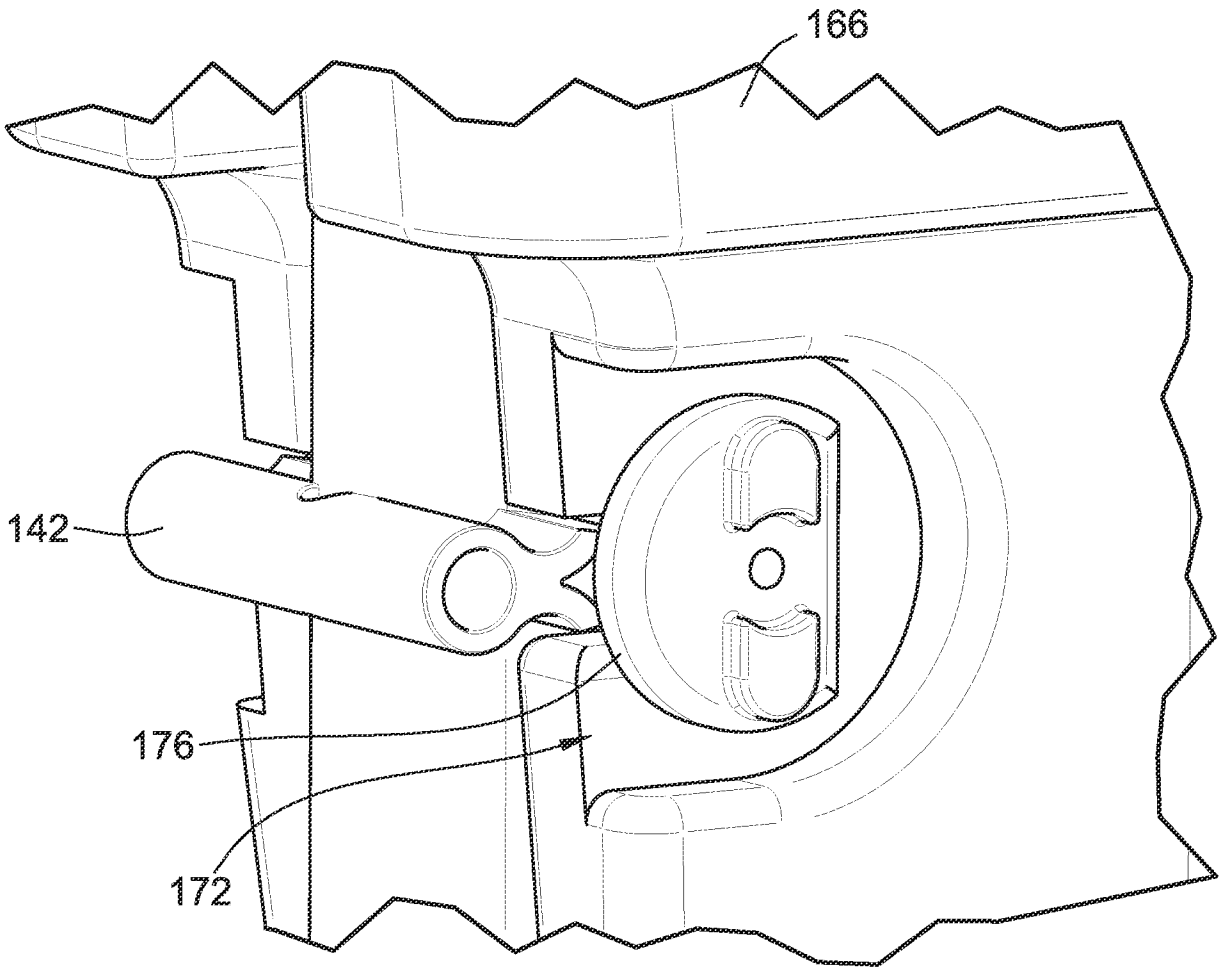
FIGS. 9 and 10 illustrate a console member of the watercraft of FIG. 1.
Figure 10:
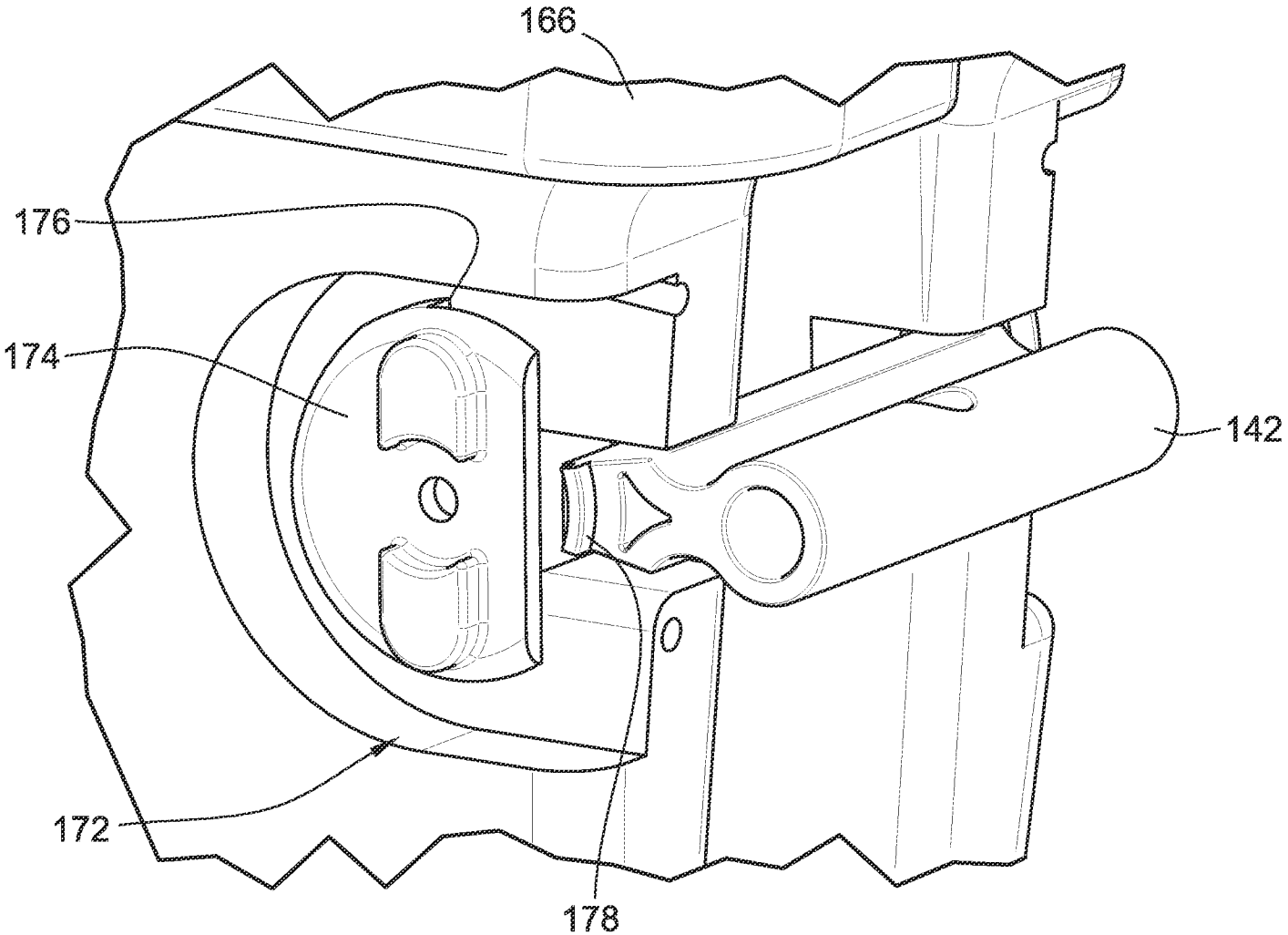
Figure 11:
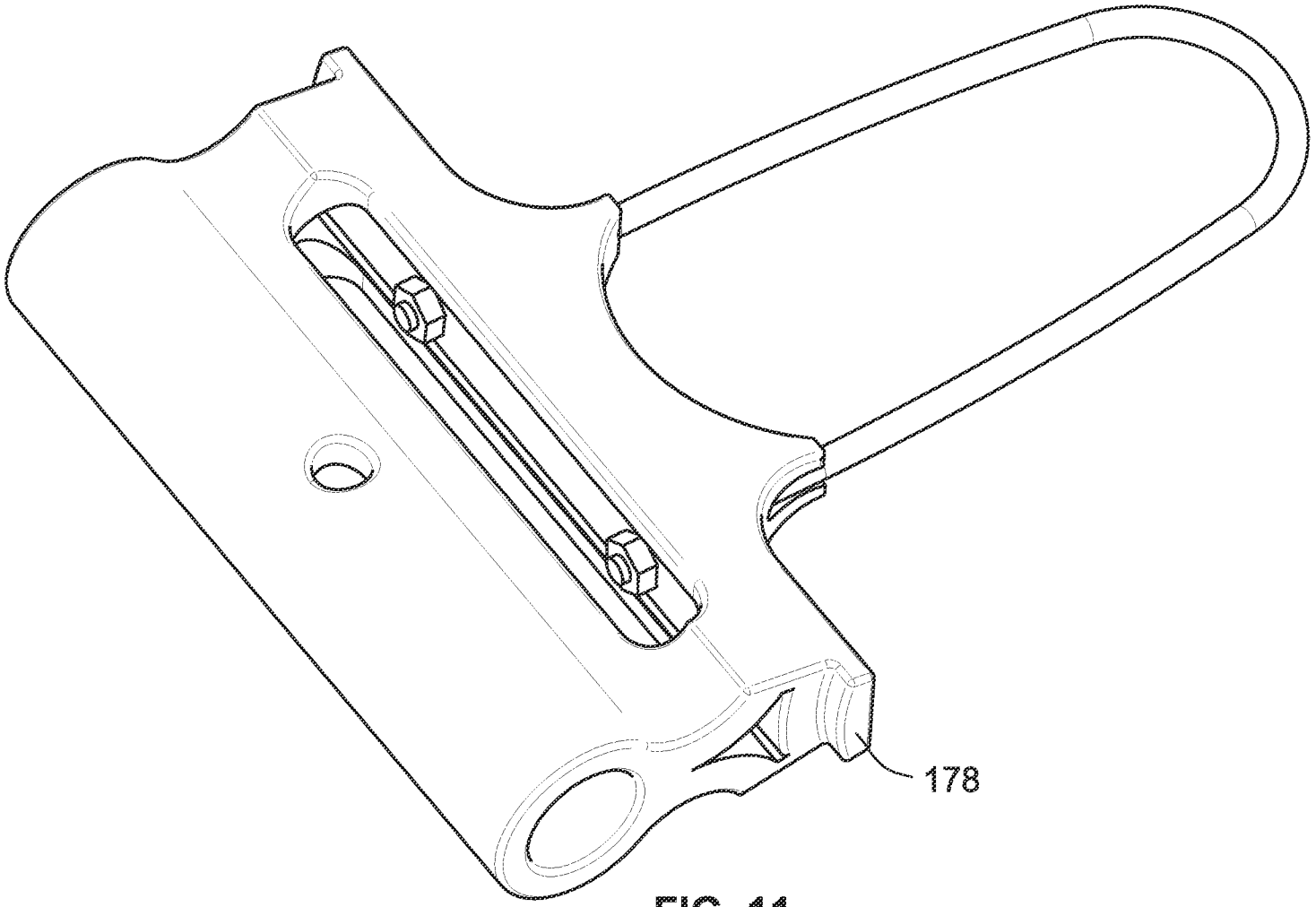
FIG. 11 is an illustration of a catch member of the drive system pivot assembly of FIG. 1.
Figure 12:
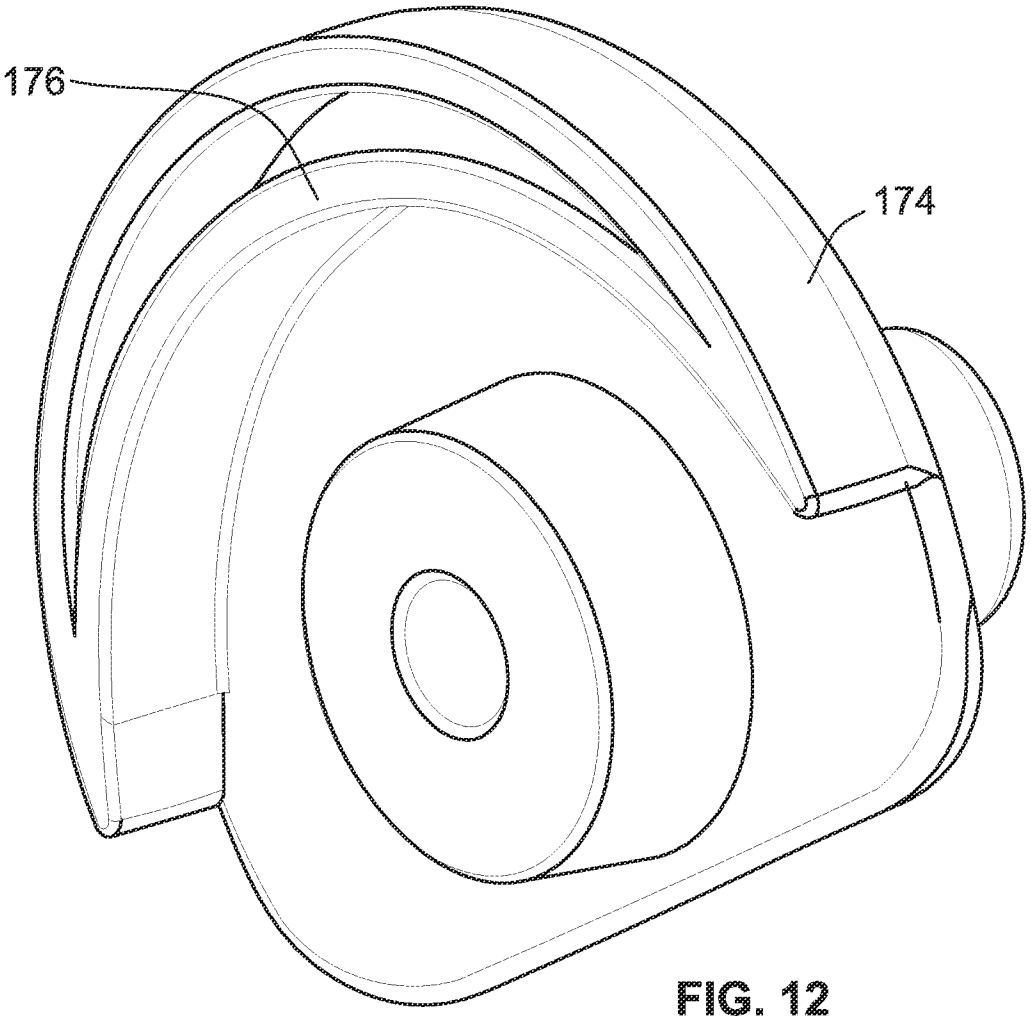
FIG. 12 is an illustration of a latch for locking the console member of FIGS. 9 and 10

In one embodiment, the console member 166 is releasably secured to the hollow member 162 by a console attachment arrangement 172. The console attachment arrangement includes a latch knob 174 on opposite sides of the console member 166. The latch knobs 174 rotate between an attached position (FIG. 9) and a released positioned (FIG. 10). The latch knobs 174 include a catch wall 176 that engages a projection formed at ends of the first linkage catch member 142 in the attached position to secure the console member 166 to the hollow member 162.

All references, including publications, patent applications, and patents cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A watercraft comprising:

a hull defining an opening therethrough from a top side to a bottom side;

a drive system having an input for receiving input force from a user and an output operably coupled to the input for providing motive force to the hull;

a drive system pivot assembly for transitioning the drive system between a deployed position and a parked position, the drive system pivot assembly including:

a first linkage member carrying the output of the drive system;

a second linkage member pivotably coupled to the first linkage member at a first pivot and pivotably coupled to the hull at a second pivot spaced from the first pivot;

a catch arrangement between the first linkage member and the hull for securing the drive system pivot assembly in the parked position, the catch arrangement including a first linkage catch member provided by the first linkage member and a first hull catch member provided by the hull, the first linkage catch member and first hull catch member engage to prevent the drive system pivot assembly from transitioning from the parked position to the deployed position.

2. The watercraft of claim 1, wherein the first linkage member pivots about the first and second pivots when transitioning between the deployed and parked positions.

3. The watercraft of claim 1, wherein one of the first linkage catch member and first hull catch member is a projection and the other one of the first linkage catch member and first hull catch member is a groove configured to receive the projection when engaged.

4. The watercraft of claim 3, wherein the groove and projection are configured such that the first linkage member must transition vertically against the force of gravity to disengage the projection from the groove.

5. The watercraft of claim 3, wherein the pivot assembly includes a cam surface adjacent the catch member in the form of a groove, the projection sliding on the cam surface during at least part of the transition from the deployed position to the parked position.

6. The watercraft of claim 1, wherein the second linkage member pivots about the second pivot in a direction away from a user operating location when transitioning from the deployed position to the parked position.

7. The watercraft of claim 1, wherein the input is a pedal system and the output is a rotating propeller operably coupled to the pedal system such that actuation of the pedal system drives the propeller.

8. The watercraft of claim 1, wherein:

in the deployed position, the output extends a first distance below a bottom of the hull; and in the parked position, the output extends a second distance below the bottom of the hull being less than the first distance or is positioned above the bottom of the hull.

9. The watercraft of claim 6, further including a docking feature interposed between the first and second linkage members limiting the pivoting motion of the first and second linkage members when in the parked position.

10. The watercraft of claim 1, wherein the hull provides a pivot groove pivotably receiving a pivot member of the second linkage member to provide the pivotable coupling between the hull and the second linkage member.

11. The watercraft of claim 10, wherein the pivot groove extends longitudinally in a direction generally perpendicular to a centerline of the hull extending between a bow and a stern of the hull.

12. The watercraft of claim 10, wherein one of the pivot groove and the pivot member has a curved surface portion providing a sliding interface between a surface defining the pivot groove and the pivot member when the pivot member is rotated about a longitudinal axis thereof as the drive system pivot assembly is transitioned between the deployed and park positions.

13. The watercraft of claim 1, wherein the hull is the hull of a kayak.

14. The watercraft of claim 9, wherein the docking feature is a U-shaped member engaging the first linkage member in the parked position.

15. The watercraft of claim 1, wherein the hull includes a hull body and an attachment plate attached to the hull body, the attachment plate providing the first hull catch member.

16. The watercraft of claim 15, wherein the attachment plate further including a second hull catch member in which the first linkage catch member resides in the parked position.

17. The watercraft of claim 1, further comprising a biasing mechanism for biasing the drive system pivot assembly from the deployed position to the parked position.

18. The watercraft of claim 17, wherein the biasing mechanism is connected between the first and second linkage members.

19. A pivoting drive system for a watercraft, the watercraft having a first mounting component and a first hull catch member, the pivoting drive system comprising:

an output for providing motive force when operated within water;

a drive system pivot assembly for transitioning the output between a deployed position and a parked position, the drive system pivot assembly including:

a first linkage member carrying the output;

a second linkage member pivotably coupled to the first linkage member at a first pivot and having a pivotable coupling configured to pivotably attach the second linkage member to the first mounting component;

a linkage catch member coupled to the first linkage member configured to engage the first hull catch member for securing the drive system pivot assembly in the parked position, the linkage catch member and first hull catch member engaging in the parked position to prevent the drive system pivot assembly from transitioning from the parked position to the deployed position.

20. The pivoting drive system of claim 19, wherein the first hull catch member is a groove and the linkage catch member is a projection configured to extend into the groove in such a manner to fix the location of the first linkage member to the second linkage member and maintain the drive system pivot assembly in the parked position.

21. The pivoting drive system of claim 20, wherein the projection is configured relative to the groove such that the first linkage member must transition vertically against the force of gravity to disengage the projection from the groove.

22. The pivoting drive system of claim 19, wherein the first mounting component is a groove extending perpendicular to a centerline of the watercraft extending between the stern and the bow of the watercraft, the pivotable coupling being a rod having an outer periphery including a curved pivot surface.

* * * * *